US011805820B2

(12) United States Patent
Lin et al.

(10) Patent No.: US 11,805,820 B2
(45) Date of Patent: Nov. 7, 2023

(54) ELECTRONIC CIGARETTE WITH VAPORIZER HAVING DUAL CAVITIES AND DUAL AIR PASSAGES

(71) Applicant: HUIZHOU HAPPY VAPING TECHNOLOGY LIMITED, Guangdong (CN)

(72) Inventors: Guangrong Lin, Guangdong (CN); Xianbin Zheng, Guangdong (CN)

(73) Assignee: HUIZHOU HAPPY VAPING TECHNOLOGY LIMITED, Huizhou (CN)

( * ) Notice: Subject to any disclaimer, the term of this patent is extended or adjusted under 35 U.S.C. 154(b) by 695 days.

(21) Appl. No.: 16/978,715

(22) PCT Filed: Jan. 18, 2019

(86) PCT No.: PCT/CN2019/072341
§ 371 (c)(1),
(2) Date: Sep. 7, 2020

(87) PCT Pub. No.: WO2019/174399
PCT Pub. Date: Sep. 19, 2019

(65) Prior Publication Data

US 2020/0397046 A1 Dec. 24, 2020

(30) Foreign Application Priority Data

Mar. 12, 2018 (CN) ..... 201810199592.2

(51) Int. Cl.
*A24F 40/30* (2020.01)
*A24F 40/485* (2020.01)
(Continued)

(52) U.S. Cl.
CPC ..... *A24F 40/485* (2020.01); *A24F 40/30* (2020.01); *A24F 40/40* (2020.01); *A24F 40/10* (2020.01); *H05B 2203/021* (2013.01)

(58) Field of Classification Search
CPC ..... A24F 40/30
See application file for complete search history.

(56) References Cited

U.S. PATENT DOCUMENTS

2014/0060556 A1* 3/2014 Liu ..... A24F 40/42 131/329
2016/0095356 A1* 4/2016 Chan ..... A24F 40/30 392/390

(Continued)

FOREIGN PATENT DOCUMENTS

CN 106690425 A 5/2017
EP 3170413 A1 * 5/2017 ..... A24B 15/167

*Primary Examiner* — Cynthia Szewczyk

(57) ABSTRACT

An electronic cigarette with a vaporizer having dual cavities and dual air passages comprises a vaporizer and a battery rod which are detachably connected, wherein the vaporizer comprises a housing and a vaporizing device. A partitioning portion divides the inner cavity of the housing into a large cavity and a small cavity. A first air outlet pipe provided in the small cavity, an air outlet through-hole provided in the vaporizing device and a second air outlet pipe provided in the battery rod are connected in sequence to form a suction sensing air passage. The air intake hole, the air inlet passage, the air inlet cavity, vaporizing chamber, the vapor tube and the vapor outlet hole which are arranged in the housing are connected in sequence to form a smoking air passage.

18 Claims, 10 Drawing Sheets

(51) Int. Cl.
*A24F 40/40* (2020.01)
*A24F 40/10* (2020.01)

(56) References Cited

U.S. PATENT DOCUMENTS

| | | | | |
|---|---|---|---|---|
| 2016/0198771 | A1* | 7/2016 | Goggin | H05B 3/44 131/329 |
| 2018/0184716 | A1* | 7/2018 | Song | A24F 40/485 |
| 2019/0387800 | A1* | 12/2019 | Lin | A24F 40/485 |

* cited by examiner

ELECTRONIC CIGARETTE WITH VAPORIZER HAVING DUAL CAVITIES AND DUAL AIR PASSAGES

TECHNICAL FIELD

The disclosure relates to the field of electronic cigarettes, more particularly to an electronic cigarette with a vaporizer having dual cavities and dual air passages.

BACKGROUND

Generally, a detachable electronic cigarette comprises a vaporizer and a battery rod. The vaporizer is provided with a liquid storage chamber for storing electronic cigarette liquid. The vaporizer is also provided with a vaporizing device configured to heat and vaporize the electronic cigarette liquid.

Chinese patent application document CN106690425A discloses a moisture-resistant electronic cigarette, which comprises a vaporizer and a battery assembly which are detachably connected. The vaporizer comprises a housing and a vaporizing device. A liquid storage chamber and a liquid absorbing chamber are arranged within the vaporizer. A vapor tube and an air inlet passage are arranged within the housing, and an air inlet cavity communicating with the air inlet passage is arranged inside the vaporizing device; a liquid guiding strip is arranged in the vaporizing chamber and is suspended, and a heating coil is wound around a middle portion of the liquid guiding strip. The two ends of the liquid guiding strip extend into the liquid absorbing chamber to absorb and deliver the cigarette liquid to the heating coil, where the cigarette liquid is heated and vaporized; the vaporizing device is provided at the bottom with first positive and negative electrodes isolated from the air inlet cavity. The first positive and negative electrodes abut respectively against the second positive and negative electrodes disposed in the inserting port of the battery rod to achieve an electrical connection therebetween. With these structures of the electronic cigarette, the air inlet passage is prevented from being vertically communicated to the vaporizing chamber and the smoking air passage. Moreover, due to the air inlet cavity which is additionally provided, the electronic cigarette vapor generated during smoking is not easy to flow back. Even if the back flow occurs, the moisture contained in the vapor would be condensed into water droplets and collected in the air inlet cavity, instead of flowing back and being condensed in the inserting port of the battery rod. Thus, the short circuit between the electrodes and corrosion damages of the circuit caused by moisture entering the battery rod are avoided, preventing the electronic cigarette from malfunctioning.

Although the above-mentioned electronic cigarette avoids a backflow of vapor into the battery rod, it has disadvantages as follows. The electronic cigarette with automatic control circuit must be provided with a suction sensor which is configured to activate the control circuit by the airflow that circulates only in the vaporizer without passing through the battery rod. However, the suction sensor, due to its size, must be installed in the battery rod instead of being installed in the vaporizer. Hence, the above-mentioned electronic cigarette can only be manually controlled by means of the button disposed on the electronic cigarette, and an intelligent control cannot be realized.

SUMMARY

Technical Problem

An object of the disclosure is to provide an electronic cigarette with a vaporizer having dual cavities and dual air passages. Due to the structure, the electronic cigarette not only can prevent the moisture from flowing back and condensing in the battery rod, but also can realize an automatic control of the electronic cigarette by sensing the suction when a user smokes.

Technical Solutions

The disclosure provides technical solutions as follows. An electronic cigarette with a vaporizer having dual cavities and dual air passages comprises a vaporizer and a battery rod which are detachably connected. The vaporizer comprises a housing, a vaporizing device and a bottom cap. The upper end of the housing is closed to form a mouthpiece end, and the lower end of the housing is completely open to form an open end. The vaporizing device is sheathed in the housing from the open end. The bottom cap is sleeved on the open end.

A partitioning portion extending downward from the mouthpiece end is axially provided inside the housing on one side, and the partitioning portion is slightly shorter than the wall portion of the housing. The partitioning portion divides the inner cavity of the housing into a large cavity and a small cavity. The upper part of the vaporizing device is sheathed in the large cavity, and the lower part of the vaporizing device abuts against the lower inner wall of the housing where the opening of the large cavity and the small cavity is located.

A vapor outlet hole is arranged at the end surface of the mouthpiece end above the large cavity. The vapor outlet hole is provided with a vapor tube extending axially into the housing, and the lower end of the vapor tube is connected to the upper part of the vaporizing device. Inside the large cavity, the space outside the vapor tube and above the vaporizing device constitutes a liquid storage chamber for storing cigarette liquid.

An air vent hole is arranged at the end surface of the mouthpiece end above the small cavity, and the air vent hole is provided with a first air outlet pipe extending axially into the small cavity. An air outlet through-hole is further provided at the lower part of the vaporizing device. The connecting portion of the battery rod is provided with a second air outlet pipe, and the second air outlet pipe is provided with a suction sensor at the port of the end which is disposed inside the battery rod. The suction sensor is configured for sensing a suction force and activating an automatic control circuit. The first air outlet pipe, the air outlet through-hole and the second air outlet pipe are connected in sequence, forming a suction sensing air passage.

Inside the small cavity, the space outside the first air outlet pipe constitutes an air inlet passage. An air intake hole is provided on the side of the housing to communicate with the air inlet passage. A vaporizing chamber is provided in the middle part of the vaporizing device, the lower part of the vaporizing chamber is provided with a communicating air inlet cavity, which is in communication with the air inlet passage, the upper part of the vaporizing chamber is in communication with the vapor tube. The air intake hole, the air inlet passage, the air inlet cavity, the vaporizing chamber, the vapor tube and the vapor outlet hole are connected in sequence to form a smoking air passage.

The vaporizing device is provided with a liquid guiding chamber horizontally surrounding the outside of the vaporizing chamber, and the liquid guiding chamber is in communication with the liquid storage chamber.

The bottom of the vaporizing device is provided with first positive and negative electrodes, and the connecting portion of the battery rod is provided with second positive and negative electrodes. The first positive and negative electrodes are connected respectively with the second positive and negative electrodes.

Preferably, the outer wall of the open end of the housing has a reduced diameter to form a plug-in portion. The bottom cap has a shape the same as the plug-in portion and is sleeved on the plug-in portion, and the bottom of the bottom cap supports the vaporizing device upwardly. The bottom of the bottom cap is provided with a first through hole which enables the air outlet through-hole and the second air outlet pipe to communicate with each other. The bottom of the bottom cap is further provided with a second through hole such that the first positive and negative electrodes could be exposed. The connecting end of the battery rod is provided with an insertion port, which allows the plug-in portion sleeved with the bottom cap to be fitted into and connected.

Preferably, the vaporizing device comprises a liquid-insulating sleeve, a vaporizing tube, a throttle lid, a heating unit, a vaporizing base, a vaporizing base support, an electrode assembly, and a sealing holder that are sequentially arranged from top to bottom. The heating unit comprises a liquid guiding strip and a heating coil wound around the middle portion of the liquid guiding strip, and the liquid guiding strip is arranged in the hollow vaporizing base.

Preferably, the inner wall of the liquid-insulating sleeve abuts the lower part of the vapor tube, and the outer wall of the liquid-insulating sleeve abuts the upper end of the vaporizing tube. The vaporizing tube is connected with the throttle lid, and the throttle lid is covered upside down on the vaporizing base. The upper part of vaporizing base support tightly abuts and supports the bottom part of the vaporizing base, and the lower part of the vaporizing base support is connected with the electrode assembly. The part of the vaporizing device above the vaporizing base support is sleeved in the large cavity; the outer wall of the sealing holder is engaged with the lower inner wall of the housing where the opening of the large cavity and the small cavity is located. The sealing holder seals both the large cavity and the small cavity, and the air outlet through-hole is provided on the sealing holder.

Preferably, the outer wall of the vaporizing base is engaged with the inner wall of the large cavity. The vaporizing base is provided in the middle portion with a cylindrical vaporizing cylinder, and the vaporizing cylinder is provided at the bottom with a vaporizing cylinder air inlet. A vaporizing base annular-shaped groove is provided on the outer circumference of the vaporizing cylinder, and the upper end of wall portion of the vaporizing cylinder is symmetrically provided with downwardly concaved notches, where the liquid guiding strip could be mounted.

The throttle lid comprises an upper cover sheet, and the upper cover sheet is arranged on the peripheral edge with a ring of throttle lid vertical wall extending downward. The throttle lid vertical wall is engaged with the inner wall of the vaporizing base. The upper cover sheet is provided in the center with a central hole, and the periphery of the central hole is provided with a downward-extending central circular tube. The inner wall of the central circular tube is sleeved on the outer wall of the vaporizing cylinder, and the central circular tube is provided, at a position corresponding to the downwardly concaved notch, with an upwardly concaved notch for accommodating the liquid guiding strip. A lid groove is provided at both sides of the central circular tube, the upper cover sheet is provided with a throttle hole communicating with the lid groove. A chamber is defined by the lid groove and the vaporizing base annular-shaped groove which are connected, and the chamber serves as the liquid guiding chamber. The lower end of the vaporizing tube is inserted between the central circular tube and the vaporizing cylinder. The lower wall of the vaporizing tube is provided, at a position corresponding to the liquid guiding strip, with an inverted U-shaped notch through which the liquid guiding strip may pass transversely.

Preferably, the vaporizing base support comprises a support plate having a cross-section the same as that of the vaporizing base. Two positioning posts are provided on the support plate, and the positioning posts are correspondingly inserted into two positioning holes formed on the bottom of the vaporizing base. The support plate is provided in the center with a support air intake hole, and the support air intake hole is provided at both sides with a lead hole through which the leads of the heating coil can pass. Four fixing posts are arranged below the support plate to fix the electrode assembly.

Preferably, the electrode assembly comprises a square body. The bottom of the square body is provided with two blind holes, in which the tubular-shaped first positive and negative electrodes are respectively arranged. The upper part of the square body is provided horizontally with two electrode connecting tubes, which are respectively integrally connected with the first positive and negative electrodes. The electrode connecting tubes, in which the leads of the heating coil pass through, are compressed such that the leads of the heating coil can be fixed and connected. The first positive and negative electrodes are formed to allow the columnar second positive and negative electrodes to insert therein.

Preferably, the bottom of the vaporizing base and the vaporizing base support are respectively provided with liquid refilling through-holes communicating with each other. The liquid refilling through-holes are in communication with the liquid guiding chamber and the liquid storage chamber. A removable plunger is arranged at the liquid refilling through-hole.

Preferably, the liquid-insulating sleeve, the vaporizing base and the sealing holder are all made of soft materials which are resistant to high temperature, and their outer walls are provided with a plurality of protruding rings to improve sealing performance.

Preferably, the cross sections of the vaporizer and the battery rod are both oval-shaped.

Advantages

An electronic cigarette with a vaporizer having dual cavities and dual air passages, due to the vaporizer provided with a smoking air passage which does not pass through the battery rod, prevents the vapor generated during smoking from flowing back into the battery rod. In this way, the malfunction resulting from the corrosion damage of the components disposed in the battery rod, which may be caused by moisture, is avoided. The electronic cigarette is further provided with a suction sensing air passage, which leads to the suction sensor in the battery rod, such that the suction sensor may automatically control the electronic cigarette by sensing suction force. The housing of the electronic cigarette vaporizer is divided into a large cavity and a small cavity, thus the two air passages can be arranged in different chambers. Moreover, a sealing holder is arranged at the bottom of the vaporizing device. With these structures, the suction sensing air passage could be extended into the battery rod, without affecting the normal function and sealing performance of the liquid storage chamber and the vapor air passage, improving user experience.

DETAILED DESCRIPTION OF ILLUSTRATED EMBODIMENTS

In order to make purposes, technical solutions and advantages of the disclosure clearer, the disclosure will be further explained in detail with reference to figures and embodiments described hereinafter.

Figure 11:
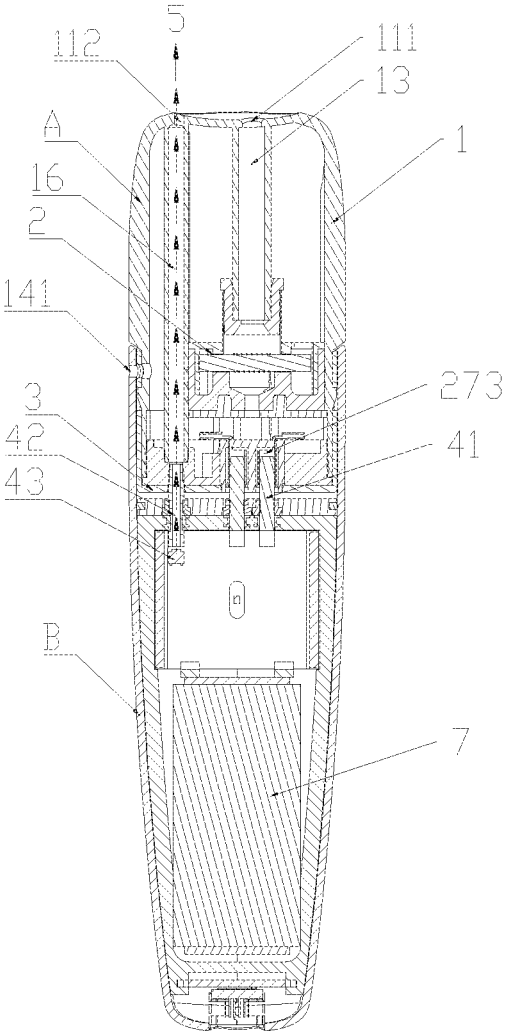
FIG. 11 is a cross-sectional view illustrating an electronic cigarette according to an embodiment of the disclosure.
Figure 12:
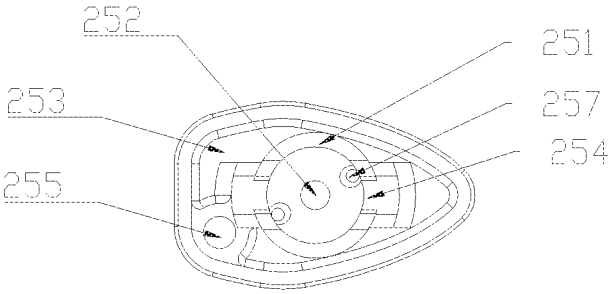
FIG. 12 is a top view illustrating a vaporizing base according to an embodiment of the disclosure.
Figure 13:
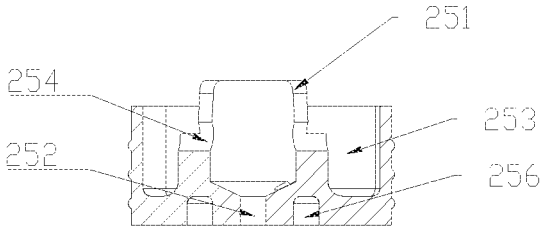
FIG. 13 is a cross-sectional view illustrating a vaporizing base according to an embodiment of the disclosure.
Figure 14:
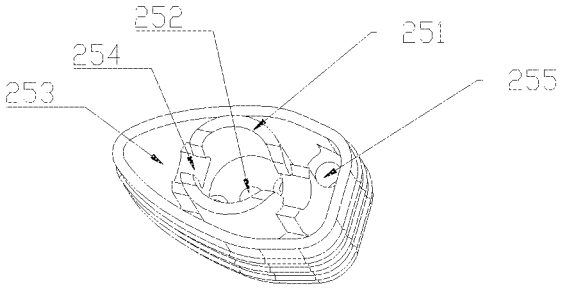
FIG. 14 is a first perspective view illustrating a vaporizing base according to an embodiment of the disclosure.
Figure 15:
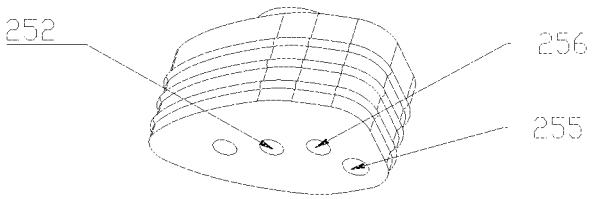
FIG. 15 is a second perspective view illustrating a vaporizing base according to an embodiment of the disclosure.
Figure 16:
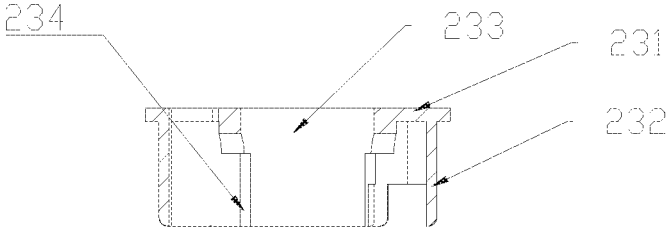
FIG. 16 is a cross-sectional view illustrating a throttle lid according to an embodiment of the disclosure.
Figure 17:
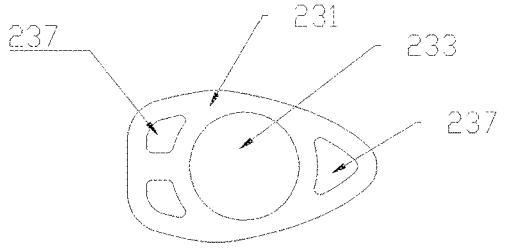
FIG. 17 is a top view illustrating a throttle lid according to an embodiment of the disclosure.
Figure 18:
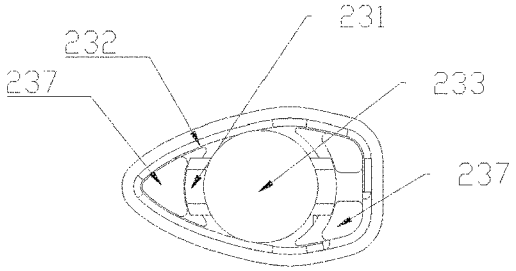
FIG. 18 is a bottom view illustrating a throttle lid according to an embodiment of the disclosure.
Figure 19:
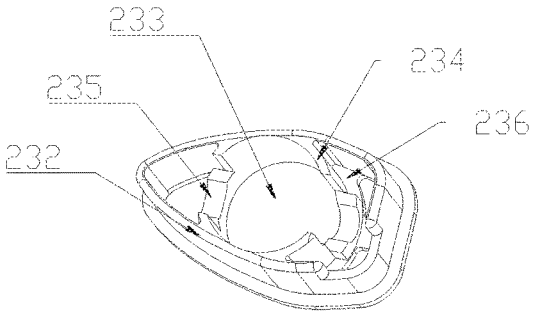
FIG. 19 is a perspective view illustrating a throttle lid according to an embodiment of the disclosure.

For convenience of description, an electronic cigarette with a vaporizer having dual cavities and dual air passages of the disclosure is illustrated when the electronic cigarette is vertically arranged, with the mouthpiece end 11 being located in the upper position, as shown in FIG. 11. The terms, such as "upper", "lower", "upper portion", "lower portion", "upper end", "lower end", "upper surface", "lower surface" "upward", "downward" as used in the disclosure, refer to position and orientation relationships when an electronic cigarette with a vaporizer having dual cavities and dual air passages is vertically arranged, with the mouthpiece end being located in the upper position.

EMBODIMENTS

Figure 1:
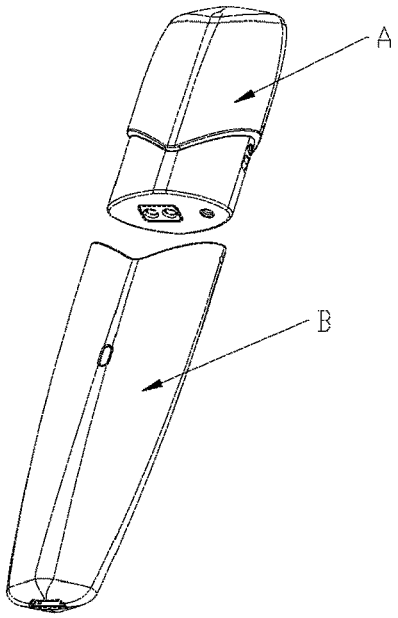
FIG. 1 is an exploded view illustrating an electronic cigarette according to an embodiment of the disclosure.
Figure 2:
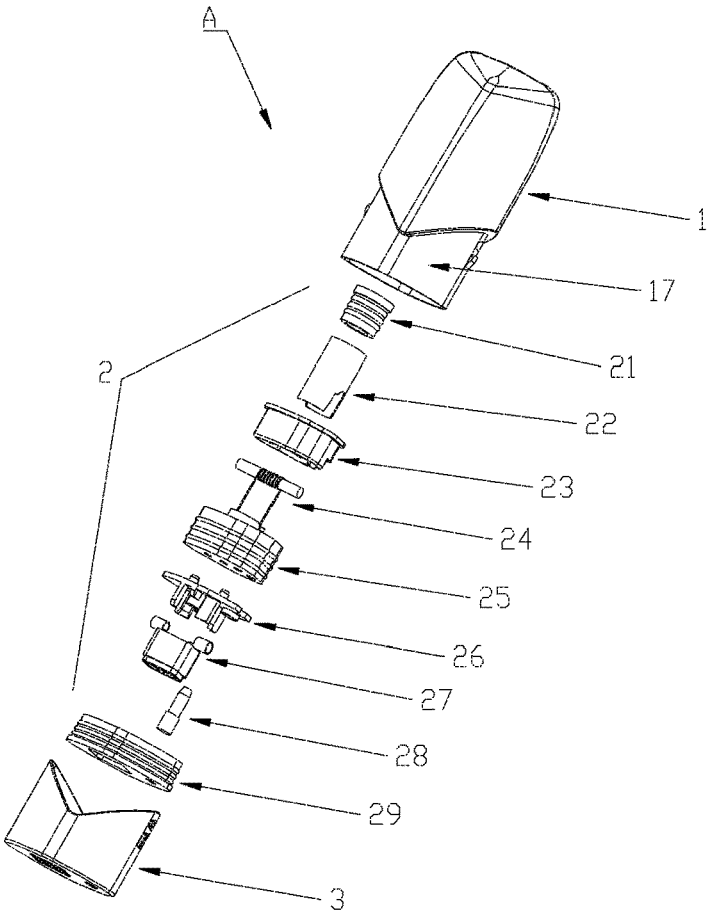
FIG. 2 is an exploded view illustrating a vaporizer according to an embodiment of the disclosure.

Referring to FIGS. 1 and 2, an electronic cigarette with a vaporizer having dual cavities and dual air passages of the disclosure comprises a vaporizer A and a battery rod B which are detachably connected. The vaporizer A comprises a housing 1, a vaporizing device 2 and a bottom cap 3.

Figure 3:
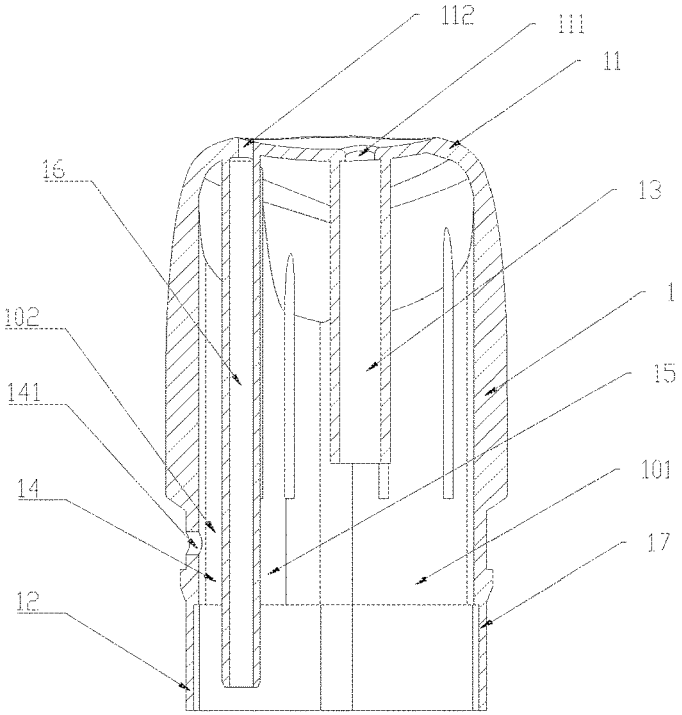
FIG. 3 is a front cross-sectional view illustrating a housing according to an embodiment of the disclosure.
Figure 4:
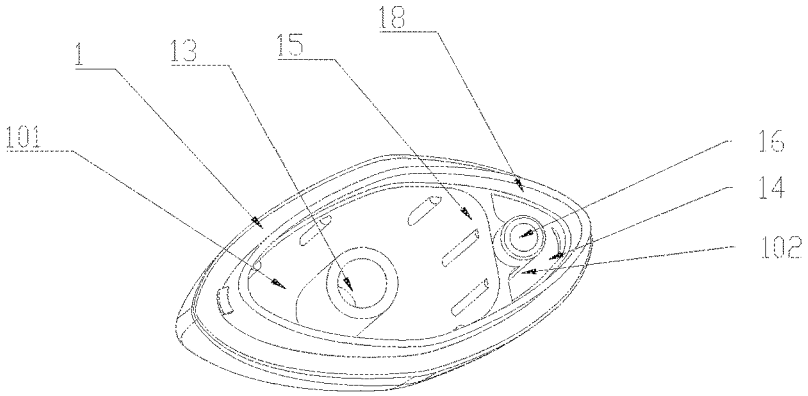
FIG. 4 is a perspective view illustrating a bottom of a housing according to an embodiment of the disclosure.
Figure 5:
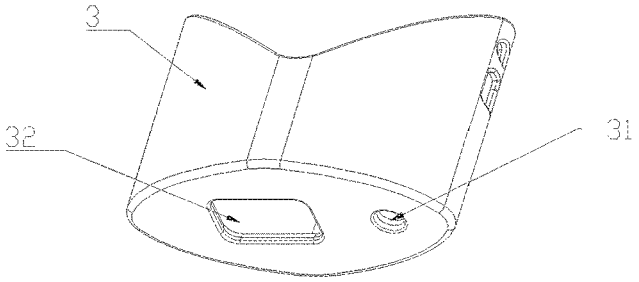
FIG. 5 is a first perspective view illustrating a bottom cap according to an embodiment of the disclosure.
Figure 6:
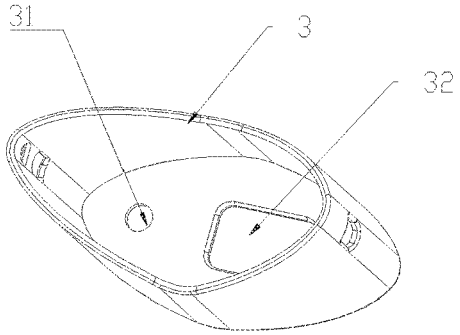
FIG. 6 is a second perspective view illustrating a bottom cap according to an embodiment of the disclosure.
Figure 7:
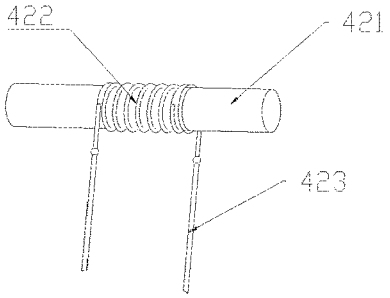
FIG. 7 is a perspective view illustrating a heating unit according to an embodiment of the disclosure.

Referring to FIGS. 3 and 4, the upper end of the housing 1 is closed to form a mouthpiece end 11, and the lower end of the housing 1 is completely open to form an open end 12. The vaporizing device 2 is sheathed in the housing 1 from the open end 12, and the bottom cap 3 is sleeved on the outer wall of the open end 12.

Referring to FIGS. 3, 4, 8, and 9, a partitioning portion 15 extending downward from the mouthpiece end 11 is axially provided inside the housing 1 on one side, and the partitioning portion 15 is slightly shorter than the wall portion of the housing 1. The partitioning portion 15 divides the inner cavity of the housing 1 into a large cavity 101 and a small cavity 102. The double cavities mentioned in the disclosure are consisted of the large cavity 101 and the small cavity 102. The upper part of the vaporizing device 2 is sheathed in the large cavity 101, and the lower part of the vaporizing device 2 abuts against the lower inner wall 18 of the housing where the opening of the large cavity 101 and the small cavity 102 is located.

Referring to FIGS. 3, 4, 8, and 9, a vapor outlet hole 111 is arranged at the end surface of the mouthpiece end 11 above the large cavity 101. The vapor outlet hole 111 is provided with a vapor tube 13 extending axially into the housing 1, and the lower end of the vapor tube 13 is connected to the upper part of the vaporizing device 2. Inside the large cavity 101, the space outside the vapor tube 13 and above the vaporizing device 2 constitutes a liquid storage chamber 103 for storing cigarette liquid. The vapor outlet hole 111 is a through hole, through which the vapor generated by the vaporizing device 2 during smoking would pass through and flow out.

Referring to FIGS. 8 to 11, an air vent hole 112 is arranged at the end surface of the mouthpiece end 11 above the small cavity 102, and the air vent hole 112 is provided with a first air outlet pipe 16 extending axially into the small cavity 102. An air outlet through-hole 290 is further provided at the lower part of the vaporizing device 2. The connecting portion 4 of the battery rod B is provided with a second air outlet pipe 42, and the port of the end of the second air outlet pipe 42 which is disposed inside the battery rod B is provided with a suction sensor 43. The suction sensor is configured for sensing suction force and activating an automatic control circuit. The first air outlet pipe 16, an air outlet through-hole 290 and the second air outlet pipe 42 are connected in sequence, forming a suction sensing air passage 5. The air vent hole 112 is a through hole, through which the air can be sucked out while the user inhales vapor from the vapor hole 111. That is, when the user inhales, the negative pressure generated at air vent hole 112, i.e., the suction force, will be transmitted from the suction sensing air passage 5 to the suction sensor 43. By sensing the user's suction force, the suction sensor 43 can determine the user's smoking intention by means of a control unit of the electronic cigarette. Then, the control unit sends out corresponding control signals to control the operation mode of the electronic cigarette, such as controlling the heating coil to heat, controlling the amount of the vapor produced, controlling the number of puffs by a user, the smoking time and anti dry-burning protection, etc., so as to realize an intelligent and automatic control of the electronic cigarette. When the vaporizer A and battery rod B of the electronic cigarette are connected, the second air outlet pipe 42 is communicated with the air outlet through-hole 290 of the vaporizing device 2, forming a suction sensing air passage 5 that does not overlap with the smoking air passage 6 described below. Therefore, the vapor generated by the vaporizer A would not flow to the suction sensing air passage, thus preventing the moisture contained in the vapor from corroding the circuit of the battery rod B.

Figure 8:
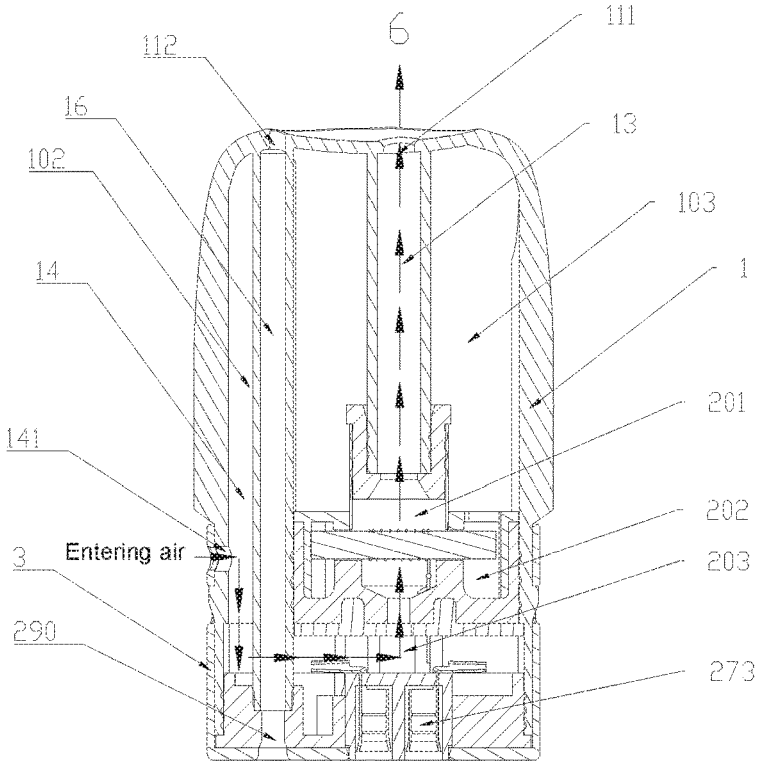
FIG. 8 is a front cross-sectional view illustrating a vaporizer according to an embodiment of the disclosure.

Referring to FIGS. 3 and 8, inside the small cavity 102, the space outside the first air outlet pipe 16 constitutes an air inlet passage 14. An air intake hole 141 is provided on the side of the housing 1 to communicate with the air inlet passage 14. A vaporizing chamber 201 is provided in the middle part of the vaporizing device 2. The lower part of the vaporizing chamber 201 is provided with an air inlet cavity 203 communicating with the vaporizing chamber 201. The air inlet cavity 203 is in communication with the air inlet passage 14 as well. The upper part of the vaporizing chamber 201 is in communication with the vapor tube 13. The air intake hole 141, the air inlet passage 14, the air inlet cavity 203, the vaporizing chamber 201, the vapor tube 13 and the vapor outlet hole 111 are connected in sequence to form a smoking air passage 6.

The dual air passages of the disclosure consist of a suction sensing air passage 5 and a smoking air passage 6. When the user smokes, the negative pressure generated at the vapor outlet hole 111 will be transmitted to the air intake hole 141 through the smoking air passage 6. The outside air enters from the air intake hole 141 and flows through the air inlet passage 14 and the air inlet cavity 203, and then flows into the vaporizing chamber 201, where the cigarette liquid is heated and vaporized to produce vapor. Then, the vapor flows along with the air entering the vaporizing chamber 201, passing through the vapor tube 13, flowing out from vapor outlet hole 111, and then may enter user's mouth. Since the whole smoking air passage 6 is disposed within the vaporizer A without passing through the battery rod B, a seal is established between the vaporizer A and the connection end of the battery rod B except the suction sensing air passage. In this way, the vapor generated by the electronic cigarette would not flow into battery rod, thus preventing the moisture contained in the vapor from corroding the circuit in the battery rod B.

Figure 9:
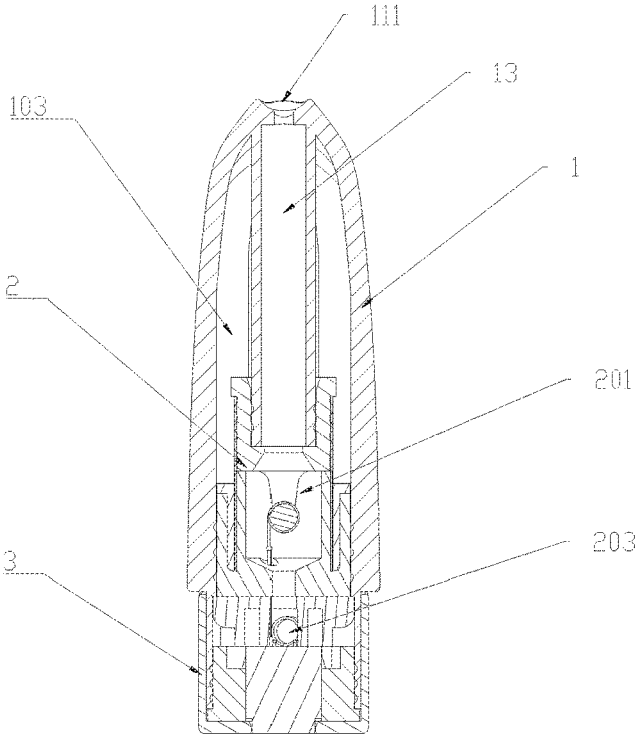
FIG. 9 is a side cross-sectional view illustrating a vaporizer according to an embodiment of the disclosure.
Figure 10:
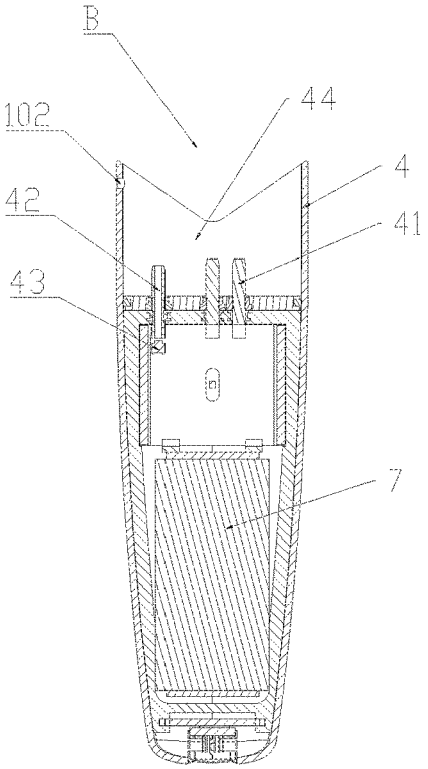
FIG. 10 is a cross-sectional view illustrating a battery rod according to an embodiment of the disclosure.

Referring to FIGS. 8, 9 and 10, the vaporizing device 2 is provided with a liquid guiding chamber 202 horizontally surrounding the outside of the vaporizing chamber 201, and the liquid guiding chamber 202 is in communication with the liquid storage chamber 103. The bottom of the vaporizing device 2 is provided with first positive and negative electrodes 273, the connecting portion of the battery rod B are provided with second positive and negative electrodes 41, and the first positive and negative electrodes 273 are connected respectively with the second positive and negative electrodes 41.

Referring to FIGS. 2, 3, 8 and 10, the outer wall of the lower end (i.e., the open end) of the housing 1 has a reduced diameter to form a plug-in portion 17. The bottom cap 3 has a shape the same as the plug-in portion 17 and is sleeved on the plug-in portion 17, and the bottom of the bottom cap 3 supports the vaporizing device 2 upwardly. The bottom of the bottom cap 3 is provided with a first through hole 31 which enables the air outlet through-hole 290 and the second air outlet pipe 42 to communicate with each other. The bottom of the bottom cap 3 is further provided with a second through hole 32 such that the first positive and negative electrodes 273 of the vaporizing device 2 could be exposed. The connecting end of the battery rod B is provided with an insertion port 44, which is configured for the bottom cap 3 to be fitted into and connected, that is, the plug-in portion 17 sleeved with the bottom cap 3 can be inserted into the insertion port 44.

Referring to FIGS. 2, 7, 8 and 11, the vaporizing device 2 comprises a liquid-insulating sleeve 21, a vaporizing tube 22, a throttle lid 23, a heating unit 24, a vaporizing base 25, a vaporizing base support 26, an electrode assembly 27, and a sealing holder 29 that are sequentially arranged from top to bottom. Herein, the heating unit 24 comprises a liquid guiding strip 241 and a heating coil 242 wound around the middle portion of the liquid guiding strip 242, and the liquid guiding strip 241 is arranged in the hollow vaporizing base 25.

Referring to FIGS. 8 and 11, the throttle lid 23 is covered upside down on the vaporizing base 25, and the vaporizing tube 22 is connected with the throttle lid 23. The inner wall of the liquid-insulating sleeve 21 abuts the lower part of the vapor tube 13, and the outer wall of the liquid-insulating sleeve 21 abuts the upper end of the vaporizing tube 22. The liquid-insulating sleeve 21 is made of high temperature resistant silicone material and has connecting and sealing functions, preventing the cigarette liquid stored in the liquid storage chamber 103 from leaking into the smoking air passage 6. The upper part of vaporizing base support 26 tightly abuts and supports the bottom part of the vaporizing base 25, and the lower part of the vaporizing base support 26 is connected with the electrode assembly 27. A gap is provided at the connection between the lower part of the vaporizing base support 26 and the electrode assembly 27 to form the air inlet cavity 203 of the vaporizing device.

The part of the vaporizing device 2 above the vaporizing base support 26 (including the vaporizing base support 26), is sleeved in the large cavity 101. The outer wall of the vaporizing base 25 is engaged with the inner wall of the large cavity 101, and the outer wall of the sealing holder 29 is engaged with the lower inner wall of the housing 1 which is not partitioned by the partitioning portion 15. The sealing holder 29 seals both the large cavity 101 and the small cavity 102, that is, the sealing holder 29 seals and isolates the large cavity 101 and the small cavity 102 from the bottom, and at the same time seals and isolates the vaporizer A and the battery rod B except for the air outlet through hole 290. The air outlet through-hole 290 is provided on sealing holder 29.

Referring to FIG. 8, the outer wall of the vaporizing base 25 is engaged with the inner wall of the large cavity 101.

Referring to FIGS. 12 to 15, the vaporizing base 25 is provided in the middle portion with a cylindrical vaporizing cylinder 251, and the vaporizing cylinder 251 is provided at the bottom with a vaporizing cylinder air inlet 252. A vaporizing base annular-shaped groove 253 is provided on the outer circumference of the vaporizing cylinder 251. The upper end of wall portion of the vaporizing cylinder 251 is symmetrically provided with downwardly concaved notches 254, where the liquid guiding strip 241 could be mounted. The vaporizing base 25 is provided with liquid refilling through-hole 255. The bottom of the vaporizing base 25 is provided with two positioning holes 256. The bottom of the vaporizing cylinder 251 is provided at both sides with blind holes 257 through which the leads can pass. The vaporizing base 25 has a vaporizing base inner wall 258 and a vaporizing base outer wall 259.

The space defined by the vaporizing cylinder 251, the vaporizing tube 22 and the bottom of the liquid-insulating sleeve 21 constitutes the vaporizing chamber 201. The liquid guiding strip 241 of the heating unit 24 is horizontally arranged in the middle of the vaporizing chamber 201 and is suspended.

Referring to FIGS. 16 to 19, the throttle lid 23 comprises an upper cover sheet 231, and the upper cover sheet 231 is arranged on the peripheral edge with a throttle lid vertical wall 232 extending downward. The throttle lid vertical wall 232 is engaged with the inner wall 258 of the vaporizing base. The upper cover sheet 231 is provided in the center with a central hole 233, and the periphery of the central hole 233 is provided with a downward-extending central circular tube 234. The inner wall of the central circular tube 234 is sleeved on the outer wall 259 of the vaporizing cylinder. The central circular tube 234 is provided, at a position corresponding to the downwardly concaved notch 254 of the vaporizing base, with an upwardly concaved notch 235 for accommodating the liquid guiding strip 241. A lid groove 236 is provided at both sides of the central circular tube 234. The upper cover sheet 23 is provided with a throttle hole 237 communicating with the lid groove 236. A chamber is defined by the lid groove 236 and the vaporizing base annular-shaped groove 253 which are connected, and the chamber serves as the liquid guiding chamber 202. The throttle hole 237 is configured to divert and throttle the cigarette liquid in the liquid storage chamber 103 to the liquid guiding chamber 202.

Figure 20:
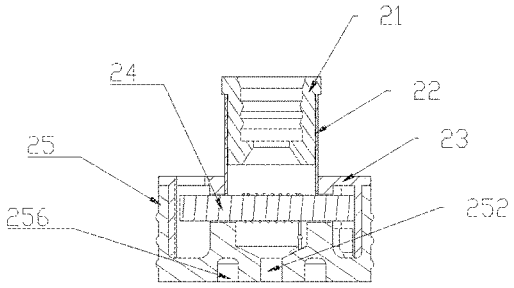
FIG. 20 is a front cross-sectional view according to an embodiment of the disclosure, in which a part of a vaporizing device above a vaporizing base is illustrated.
Figure 21:
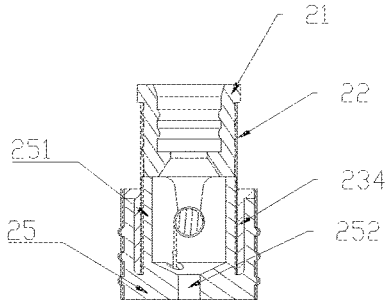
FIG. 21 is a side cross-sectional view according to an embodiment of the disclosure, in which a part of a vaporizing device above a vaporizing base is illustrated.
Figure 22:
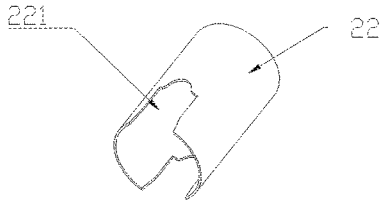
FIG. 22 is a perspective view illustrating a vaporizing tube according to an embodiment of the disclosure.

Referring to FIGS. 20 to 22, the lower end of the vaporizing tube 22 is inserted between the central circular tube 234 and the vaporizing cylinder 251. The lower wall of the vaporizing tube 22 is provided, at a position corresponding to the liquid guiding strip 241, with an inverted U-shaped notch 221 through which the liquid guiding strip 241 may pass transversely.

Figure 23:
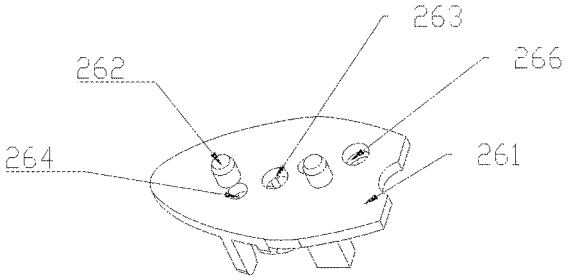
FIG. 23 is a first perspective view illustrating a vaporizing base support according to an embodiment of the disclosure.
Figure 24:
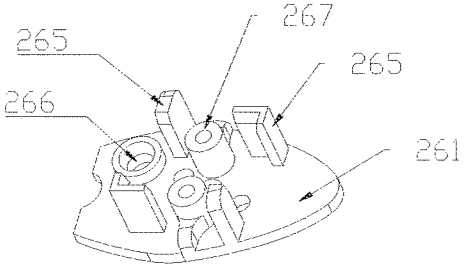
FIG. 24 is a second perspective view illustrating a vaporizing base support according to an embodiment of the disclosure.
Figure 25:
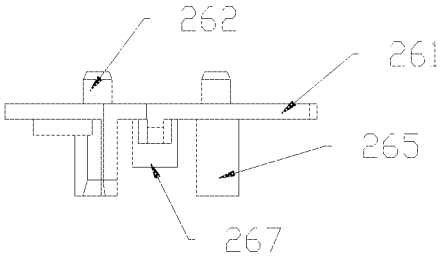
FIG. 25 is a front view illustrating a vaporizing base support according to an embodiment of the disclosure.

Referring to FIGS. 23 to 25, the vaporizing base support 26 comprises a support plate 261 having a cross-section the same as that of the vaporizing base 25 (i.e., the support plate 261 has the same shape as the bottom surface of the vaporizing base 25). Two positioning posts 262 are provided on the support plate 261, and the positioning posts 262 are correspondingly inserted into two positioning holes 256 formed on the bottom of the vaporizing base 25. When the positioning posts 262 are inserted into the positioning holes 256, the vaporizing base 25 can be accurately connected and fixed on the vaporizing base support 26, and displacement therebetween can be prevented. The support plate 261 is provided in the center with a support air intake hole 263, and the support air intake hole 263 is provided at both sides with a lead hole 264 through which the leads 243 of the heating coil can pass. Four fixing posts 265 are arranged below the support plate 261 to fix the electrode assembly 27. The support plate 261 is also provided with a liquid refilling through-hole 266, and a pillar 267 is arranged below the support plate 261.

Figure 26:
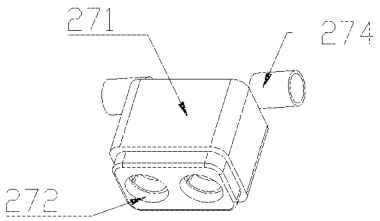
FIG. 26 is a cross-sectional view illustrating an electrode assembly according to an embodiment of the disclosure.
Figure 27:
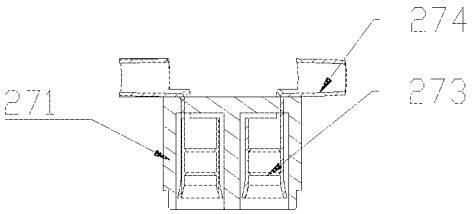
FIG. 27 is a first perspective view illustrating an electrode assembly according to an embodiment of the disclosure.
Figure 28:
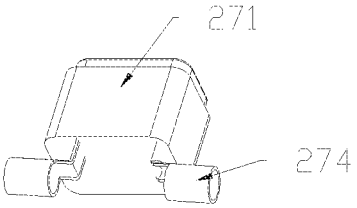
FIG. 28 is a second perspective view illustrating an electrode assembly according to an embodiment of the disclosure.

Referring to FIGS. 26 to 28, the electrode assembly 27 comprises a square body 271 made of plastic material. The bottom of the square body 271 is provided with two blind holes 272, in which the tubular-shaped first positive and negative electrodes 273 are respectively arranged. The upper part of the square body 271 is provided horizontally with two electrode connecting tubes 274, which are respectively integratedly formed with the first positive and negative electrodes 273. The square body 271, the first positive and negative electrodes 273, and the electrode connecting tube 274 are manufactured by adopting a method of one-time forming in double injection mould. The electrode connecting tubes 274 would, after the leads 243 of the heating coil being inserted therein, be compressed such that the leads 243 of the heating coil would be fixed and connected, which helps simplify the manufacturing process, eliminate the soldering process, save costs and improve the productivity. The first positive and negative electrodes 273 are formed in a tube shape so that the columnar second positive and negative electrodes 41 can be inserted therein.

Referring to FIGS. 2, 14, 15, 23 and 25, the bottom of the vaporizing base 25 and vaporizing base support 26 are respectively provided with liquid refilling through-hole 255 and liquid refilling through-hole 266 communicating with each other. The liquid refilling through-hole 255 and liquid refilling through-hole 266 are in communication with the liquid guiding chamber 202 and the liquid storage chamber 103. Through the liquid refilling through-holes 255 and 266, the user could refill electronic cigarette liquid after it is exhausted. A detachable plunger 28 is provided respectively in the liquid refilling through-hole 255 and liquid refilling through-hole 266. When the electronic cigarette liquid is used up, the plunger 28 can be opened for the user to refill the liquid, and then the plunger 28 would be installed back to block the liquid refilling through-holes after the refilling is completed.

Figure 29:
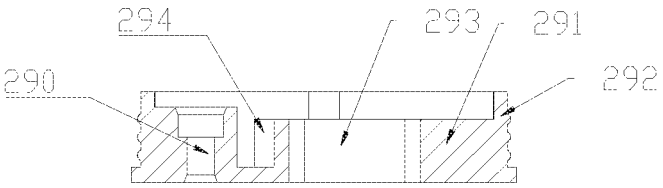
FIG. 29 is a cross-sectional view illustrating a sealing holder according to an embodiment of the disclosure.
Figure 30:
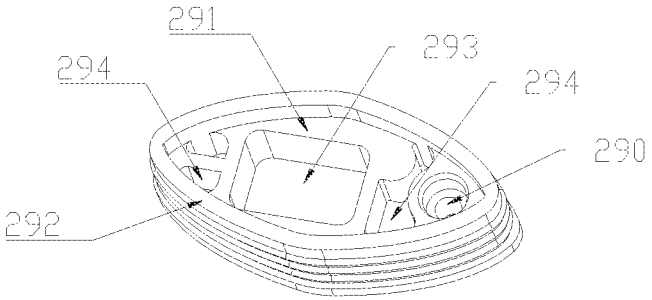
FIG. 30 is a perspective view illustrating a sealing holder according to an embodiment of the disclosure.

Referring to FIGS. 29 to 30, the sealing holder 29 comprises a bottom plate 291 and a wall portion 292. The outer wall of the wall portion 292 has a shape the same as the inner wall of the lower edge of the housing 1. The air outlet through-hole 290 is arranged at one side of the bottom plate 291, and a rectangular hole 293, which is configured to accommodate and enclose the square body 271 of the electrode assembly, is arranged in the middle of the bottom plate 291. The bottom plate 291 is further provided with a moisture collecting groove 294 for collecting water vapor.

Referring to FIGS. 2, 8, 9, 14, 15, the liquid-insulating sleeve 21, the vaporizing base 25 and the sealing holder 29 are all made of soft materials which are resistant to high temperature, and their outer walls are provided with a plurality of protruding rings to improve sealing performance.

Referring to FIGS. 1 and 2, the cross sections of the vaporizer A and the battery rod B are both oval-shaped. The oval-shaped electronic cigarette can be stably placed and would not easily roll around, thus preventing the electronic cigarette from falling down and getting broken.

As stated above, the electronic cigarette of the disclosure is provided with two different air passages 5 and 6, the housing 1 of the vaporizer is divided into a large cavity 101 and a small cavity 102, the two air passages 5 and 6 are respectively arranged in the different chambers, and a sealing holder 29 is arranged at the bottom of the housing 1. With these structures, the air circulating in the two air passages is prevented from leaking to each other or mixing together. Moreover, the smoking air passage 6 and the suction sensing air passage 5 in the vaporizing device could be respectively isolated and enclosed from the cigarette liquid flow channel (including the liquid storage chamber 103 and the liquid guiding chamber 202), which makes it possible for the suction sensing air passage 5 be extended into the battery rod, without affecting the normal function and sealing performance of the liquid storage chamber and the smoking air passage.

INDUSTRIAL APPLICABILITY

All the above are merely preferred embodiments of the disclosure, which are not intended to limit the present invention in any form. The present invention is intended to cover all changes, various modifications and equivalent arrangements those skilled in the art can make according to the technical essence of the present invention.

The invention claimed is:

1. An electronic cigarette with a vaporizer having dual cavities and dual air passages, wherein the electronic cigarette comprises a vaporizer and a battery rod which are detachably connected, the vaporizer comprises a housing, a vaporizing device and a bottom cap, an upper end of the housing is closed to form a mouthpiece end, and a lower end of the housing is completely open to form an open end, through which the vaporizing device is sheathed in the housing, and the bottom cap is sleeved on the open end;

a partitioning portion extending downward from the mouthpiece end is axially provided inside the housing on one side, the partitioning portion is slightly shorter than a wall portion of the housing, and divides an inner cavity of the housing into a large cavity and a small cavity, an upper part of the vaporizing device is sheathed in the large cavity, and a lower part of the vaporizing device abuts against a lower inner wall of the housing where openings of the large cavity and the small cavity are located;

a vapor outlet hole is arranged at an end surface of the mouthpiece end above the large cavity, the vapor outlet hole is provided with a vapor tube extending axially into the housing, a lower end of the vapor tube is connected to the upper part of the vaporizing device, and inside the large cavity, a space outside the vapor tube and above the vaporizing device defines a liquid storage chamber for storing cigarette liquid;

an air vent hole is arranged at the end surface of the mouthpiece end above the small cavity, the air vent hole is provided with a first air outlet pipe extending axially into the small cavity, an air outlet through-hole is further provided at the lower part of the vaporizing device, a connecting portion of the battery rod is provided with a second air outlet pipe, the second air outlet pipe is provided with a suction sensor at a port of an end which is disposed inside the battery rod, the suction sensor is configured for sensing a suction force and activating an automatic control circuit, and the first air outlet pipe, the air outlet through-hole and the second air outlet pipe are connected in sequence to form a suction sensing air passage;

inside the small cavity, a space outside the first air outlet pipe defines an air inlet passage, an air intake hole is provided on a side of the housing to communicate with the air inlet passage, a vaporizing chamber is provided in a middle part of the vaporizing device, a lower part of the vaporizing chamber is provided with a communicating air inlet cavity, which is in communication with the air inlet passage, an upper part of the vaporizing chamber is in communication with the vapor tube, and the air intake hole, the air inlet passage, the air inlet cavity, the vaporizing chamber, the vapor tube and the vapor outlet hole are in communication in sequence to form a smoking air passage;

the vaporizing device is provided with a liquid guiding chamber horizontally surrounding an outside of the vaporizing chamber, and the liquid guiding chamber is in communication with the liquid storage chamber; and a bottom of the vaporizing device is provided with first positive and negative electrodes, and the connecting portion of the battery rod is provided with second positive and negative electrodes, and the first positive and negative electrodes are connected respectively with the second positive and negative electrodes.

2. The electronic cigarette with a vaporizer having dual cavities and dual air passages according to claim 1, wherein an outer wall of the open end of the housing has a reduced diameter to form a plug-in portion, the bottom cap has a shape the same as the plug-in portion and is sleeved on the plug-in portion, and a bottom of the bottom cap supports the vaporizing device upwardly, the bottom of the bottom cap is provided with a first through hole which enables the air outlet through-hole and the second air outlet pipe to communicate with each other, the bottom of the bottom cap is further provided with a second through hole to expose the first positive and negative electrodes, a connecting end of the battery rod is provided with an insertion port, which allows the plug-in portion sleeved with the bottom cap to be fitted into and connected.

3. The electronic cigarette with a vaporizer having dual cavities and dual air passages according to claim 2, wherein cross sections of the vaporizer and the battery rod are both oval-shaped.

4. The electronic cigarette with a vaporizer having dual cavities and dual air passages according to claim 1, wherein the vaporizing device comprises a liquid-insulating sleeve, a vaporizing tube, a throttle lid, a heating unit, a vaporizing base, a vaporizing base support, an electrode assembly, and a sealing holder that are sequentially arranged from top to bottom, the heating unit comprises a liquid guiding strip and a heating coil wound around a middle portion of the liquid guiding strip, and the liquid guiding strip is arranged in the vaporizing base which is hollow.

5. The electronic cigarette with a vaporizer having dual cavities and dual air passages according to claim 4, wherein an inner wall of the liquid-insulating sleeve abuts a lower part of the vapor tube, and an outer wall of the liquid-insulating sleeve abuts an upper end of the vaporizing tube, the vaporizing tube is connected with the throttle lid, the throttle lid is covered upside down on the vaporizing base, an upper part of vaporizing base support tightly abuts and supports a bottom part of the vaporizing base, a lower part of the vaporizing base support is connected with the electrode assembly, a part of the vaporizing device above the vaporizing base support is sleeved in the large cavity; an outer wall of the sealing holder is engaged with the lower inner wall of the housing where the openings of the large cavity and the small cavity are located, the sealing holder seals both the large cavity and the small cavity, and the air outlet through-hole is provided on the sealing holder.

6. The electronic cigarette with a vaporizer having dual cavities and dual air passages according to claim 5, wherein cross sections of the vaporizer and the battery rod are both oval-shaped.

7. The electronic cigarette with a vaporizer having dual cavities and dual air passages according to claim 4, wherein an outer wall of the vaporizing base is engaged with an inner wall of the large cavity, the vaporizing base is provided in a middle portion with a cylindrical vaporizing cylinder, and the vaporizing cylinder is provided at a bottom with a vaporizing cylinder air inlet, a vaporizing base annular-shaped groove is provided on an outer circumference of the vaporizing cylinder, an upper end of a wall portion of the vaporizing cylinder is symmetrically provided with downwardly concaved notches to allow for mounting of, the liquid guiding strip; the throttle lid comprises an upper cover sheet, and the upper cover sheet is arranged on a peripheral edge with a throttle lid vertical wall extending downward, the throttle lid vertical wall is engaged with an inner wall of the vaporizing base, the upper cover sheet is provided in a center with a central hole, and a periphery of the central hole is provided with a downward-extending central circular tube, an inner wall of the central circular tube is sleeved on an outer wall of the vaporizing cylinder, the central circular tube is provided, at a position corresponding to the downwardly concaved notches, with an upwardly concaved notch for accommodating the liquid guiding strip, a lid groove is provided at both sides of the central circular tube, the upper cover sheet is provided with a throttle hole communicating with the lid groove, the liquid guiding chamber is defined by the lid groove and the vaporizing base annular-shaped groove which are connected, a lower end of the vaporizing tube is inserted between the central circular tube and the vaporizing cylinder, a lower wall of the vaporizing tube is provided, at a position corresponding to the liquid guiding strip, with an inverted U-shaped notch through which the liquid guiding strip may pass transversely.

8. The electronic cigarette with a vaporizer having dual cavities and dual air passages according to claim 7, wherein cross sections of the vaporizer and the battery rod are both oval-shaped.

9. The electronic cigarette with a vaporizer having dual cavities and dual air passages according to claim 4, wherein the vaporizing base support comprises a support plate having a cross-section the same as that of the vaporizing base, two positioning posts are provided on the support plate, and the positioning posts are correspondingly inserted into two positioning holes formed on a bottom of the vaporizing base; the support plate is provided in a center with a support air intake hole, and the support air intake hole is provided at both sides with a lead hole through which leads of the heating coil can pass; and four fixing posts are arranged below the support plate to fix the electrode assembly.

10. The electronic cigarette with a vaporizer having dual cavities and dual air passages according to claim 9, wherein cross sections of the vaporizer and the battery rod are both oval-shaped.

11. The electronic cigarette with a vaporizer having dual cavities and dual air passages according to claim 4, wherein the electrode assembly comprises a square body, a bottom of the square body is provided with two blind holes, in which the first positive and negative electrodes which are tubular-shaped are respectively arranged, an upper part of the square body is provided horizontally with two electrode connecting tubes, which are respectively integrally connected with the first positive and negative electrodes, the electrode connecting tubes, in which leads of the heating coil pass through, are compressed to fix the leads of the heating coil, and the first positive and negative electrodes are formed to allow the second positive and negative electrodes which are columnar to insert therein.

12. The electronic cigarette with a vaporizer having dual cavities and dual air passages according to claim 11, wherein cross sections of the vaporizer and the battery rod are both oval-shaped.

13. The electronic cigarette with a vaporizer having dual cavities and dual air passages according to claim 4, wherein a bottom of the vaporizing base and the vaporizing base support are respectively provided with liquid refilling through-holes communicating with each other, the liquid refilling through-holes are in communication with the liquid guiding chamber and the liquid storage chamber, and a removable plunger is arranged at the liquid refilling through-hole.

14. The electronic cigarette with a vaporizer having dual cavities and dual air passages according to claim 13, wherein cross sections of the vaporizer and the battery rod are both oval-shaped.

15. The electronic cigarette with a vaporizer having dual cavities and dual air passages according to claim 4, wherein the liquid-insulating sleeve, the vaporizing base and the sealing holder are all made of soft materials which are resistant to high temperature, and outer walls of the liquid-insulating sleeve, the vaporizing base and the sealing holder are provided with a plurality of protruding rings to improve sealing performance.

16. The electronic cigarette with a vaporizer having dual cavities and dual air passages according to claim 15, wherein cross sections of the vaporizer and the battery rod are both oval-shaped.

17. The electronic cigarette with a vaporizer having dual cavities and dual air passages according to claim 4, wherein cross sections of the vaporizer and the battery rod are both oval-shaped.

18. The electronic cigarette with a vaporizer having dual cavities and dual air passages according to claim 1, wherein cross sections of the vaporizer and the battery rod are both oval-shaped.

* * * * *